US005406439A

United States Patent [19]

Crane et al.

[11] Patent Number: 5,406,439

[45] Date of Patent: Apr. 11, 1995

[54] FEEDBACK OF RELAY STATUS

[75] Inventors: Burke J. Crane, Lombard, Ill.; Garth S. Jones, Virginia Beach, Va.

[73] Assignee: Molex Incorporated, Lisle, Ill.

[21] Appl. No.: 26,658

[22] Filed: Mar. 5, 1993

[51] Int. Cl.[6] ..... H01H 47/22

[52] U.S. Cl. ..... 361/152; 361/186; 307/127

[58] Field of Search ..... 361/152, 153, 154, 186, 361/166, 168.1, 169.1, 170, 171, 172; 307/125, 127, 139

[56] References Cited

U.S. PATENT DOCUMENTS

| | | | |
|---|---|---|---|
| 4,293,888 | 10/1981 | McCarty | 361/152 |
| 4,433,357 | 2/1984 | Nishimura et al. | 361/196 |
| 4,907,122 | 3/1990 | Tamura | 361/186 |
| 5,016,134 | 5/1991 | Chang et al. | 361/153 |

*Primary Examiner*—Jeffrey A. Gaffin

*Attorney, Agent, or Firm*—Stephen Z. Weiss

[57] ABSTRACT

A switched receptacle includes a latching relay selectively providing power to an outlet receptacle. A drive circuit for the latching relay provides indirect feedback to a logic controller which follows or tracks each relay operation to ensure that the relay is in the commanded mode.

17 Claims, 3 Drawing Sheets

FEEDBACK OF RELAY STATUS

FIELD OF THE INVENTION

This invention relates to control of a latching relay and, more particularly, to feedback of relay status.

BACKGROUND OF THE INVENTION

In providing electrical circuits to a facility, such as a home, one or more branch circuits are wired to distribute electrical power to load devices, such as light fixtures or outlet receptacles. Typically, the receptacle or fixture is hardwired directly to the branch circuit, with power to the device being turned on or off at the device itself. For example, a light fixture might include a pull cord for actuating a switch, while a small appliance might include a power switch.

With recent technological developments it is both possible and advantageous to provide automated control of load devices to provide, for example, remote or timed switching. One such system directs all communication functions into a master system controller. This gives a homeowner flexible communication and power control from anywhere in the home there is a control panel or switch, or even anywhere there is a telephone, such as the car or office. An intelligent outlet receptacle or fixture block allows individual appliances or fixtures to be separately and automatically controlled as necessary or desired. To do so, some means must be provided for controlling switching of power to the load device. To be practical, the switching must be done inexpensively and accurately. A latching relay has been found to be readily adaptable to such an application. A latching relay is latched when connected to a positive polarity voltage source and unlatched when connected to a negative polarity voltage source.

A relay of the remnant latching type is permanently magnetized so that upon actuation by a relatively high current pulse of positive polarity an included plunger is magnetically retained in an actuated position. When a reverse polarity power source is connected the magnetic field is reduced so that a spring force returns the plunger to an unlatched position. A short duration pulse must be used to avoid over-magnetization with opposite magnetic polarity.

Because only a short duration pulse is used for latching and unlatching, it is important to ensure that the relay actually does change state when commanded to do so. Desirably, a feedback circuit is used to sense state of the relay. A known such feedback circuit senses relay status directly by sensing AC voltage applied to a load. However, such a circuit is susceptible to a delayed response if a load has a relatively large reactive component which might sustain voltage too long after the associated relay opens. If this occurs, the latching relay control might continue trying to shut off the relay. Repetitive driving of the relay can damage the relay or other components due to overheating. Also, this might result in over-magnetization with opposite magnetic polarity.

The present invention is intended to overcome one or more of the problems discussed above in a novel and simple manner.

SUMMARY OF THE INVENTION

In accordance with the invention, there is provided a latching relay control circuit using indirect feedback of relay status.

Broadly, there is disclosed herein a control circuit controlling switching of a latching relay having a relay coil and an electrical contact switched by the relay coil. The relay coil is latched when connected to a positive polarity voltage source and unlatched when connected to a negative polarity voltage source. The control circuit includes a power source developing a voltage at a select potential. A command circuit develops a command signal. The command signal assumes a first state to latch the relay coil or a second state to unlatch the relay coil. A controllable switch circuit is connected between the power source and the relay coil for selectively supplying a positive polarity voltage or a negative polarity voltage to the relay coil. A drive circuit is electrically connected between the command circuit and the switch circuit for controlling the switch circuit to supply a positive polarity voltage when the command signal assumes the first state and to supply a negative polarity voltage when the command signal assumes the second state. The drive circuit includes a memory circuit storing a digital value representing if the voltage most recently supplied to the relay coil was of positive polarity or negative polarity. The digital value is transferred to the command circuit to ensure that the relay coil is in its desired state.

It is a feature of the invention that the memory circuit comprises a flip-flop circuit tracking state of the relay coil.

It is another feature of the invention that the drive circuit includes a timing circuit triggered by the command signal for controlling the switch circuit, wherein the flip-flop circuit is connected between the timing circuit and the switch circuit.

It is a further feature of the invention that the digital value controls the polarity of voltage supplied by the switch circuit and the timing circuit selectively enables the switch circuit.

It is a further feature of the invention that the switch circuit comprises an H-bridge switch circuit.

It is yet another feature of the invention to provide a voltage sense circuit for sensing the select potential of the power source voltage and an inhibit circuit connected between the sense circuit and the drive circuit for inhibiting operation of the drive circuit if the select potential is below a select value.

There is disclosed in accordance with another aspect of the invention a switched power receptacle comprising a power source developing a voltage at a select potential. A latching relay has a relay coil and an electrical contact switched by the relay coil. The relay coil is latched when connected to a positive polarity voltage source and unlatched when connected to a negative polarity voltage source. An outlet receptacle is connected in series with the contact to the power source. A command circuit develops a command signal. The command signal assumes a first state to latch the relay coil to power the outlet receptacle or a second state to unlatch the relay coil to disable the outlet receptacle. A controllable switch circuit is connected between the power source and the relay coil for selectively supplying a positive polarity voltage or a negative polarity voltage to the relay coil. A drive circuit is electrically connected between the command circuit and the drive circuit for controlling the switch circuit to supply a positive polarity voltage when the command signal assumes the first state and to supply a negative polarity voltage when the command signal assumes the second state. The drive circuit includes a memory circuit storing a digital value representing if the voltage most recently supplied to the relay coil was of positive polarity or negative polarity. The digital value is transferred to the command circuit to ensure that the relay coil is in its desired state.

There is disclosed in accordance with yet another aspect of the invention a switched power receptacle comprising a power source developing a voltage at a select potential. A latching relay has a relay coil and an electrical contact switched by the relay coil. The relay coil is latched when connected to a positive polarity voltage source and unlatched when connected to a negative polarity voltage source. An outlet receptacle is connected in series with the contact to the power source. A command circuit develops a command signal. The command signal assumes a first state to latch the relay coil to power the outlet receptacle or a second state to unlatch the relay coil to disable the outlet receptacle. An H-bridge circuit is connected between the power source and the relay coil. A drive circuit is electrically connected between the command circuit and the H-bridge circuit for controlling the H-bridge circuit between a set mode and a reset mode. The set mode comprises controlling the H-bridge circuit to supply a positive polarity voltage when the command signal assumes the first state. The reset mode comprises controlling the H-bridge circuit to supply a negative polarity voltage when the command signal assumes the second state. The drive circuit includes a memory circuit storing a digital value representing the mode, the digital value being transferred to the command circuit to ensure that the relay coil is in its desired state.

DETAILED DESCRIPTION OF THE INVENTION

Figure 1:
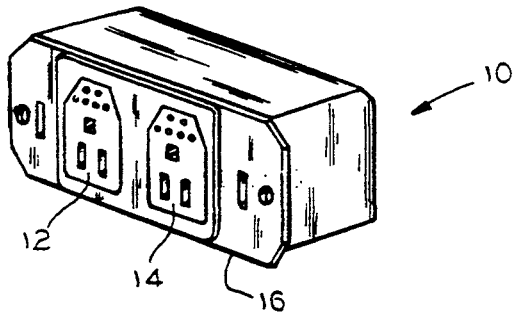
FIG. 1 is a perspective view of a switched power receptacle according to the invention.

With reference to FIG. 1, a switched power receptacle 10 in accordance with the invention is illustrated. The switched power receptacle 10 includes a first outlet receptacle 12 and a second outlet receptacle 14, each included in a housing 16. Each outlet receptacle 12 and 14 is adapted to receive a conventional three-prong plug for selectively providing electrical power thereto. The illustrated outlet receptacles 12 and 14 include additional receptacle structure for data communications which are not relevant to the claimed invention and therefore are not described in detail herein.

Figure 2A:
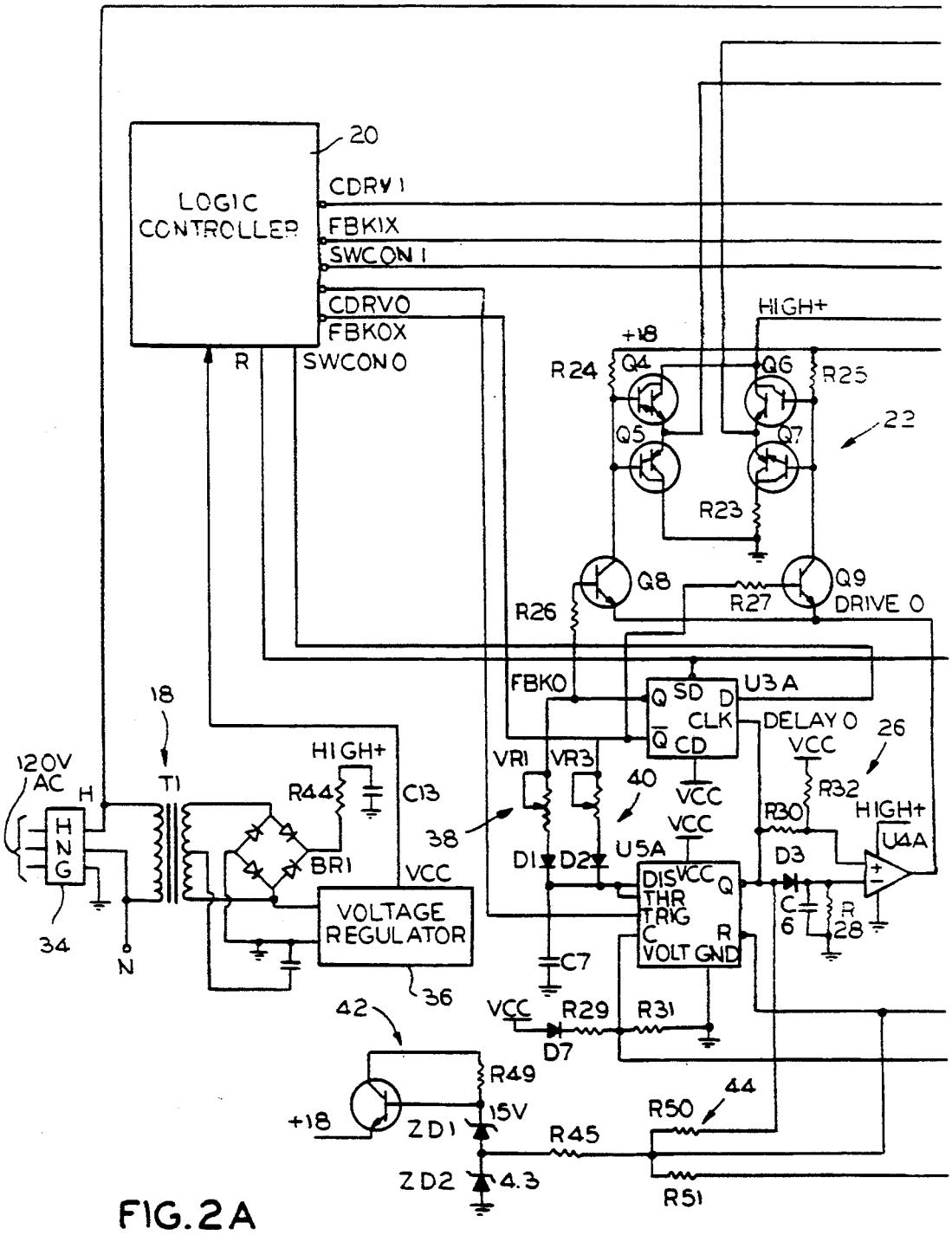
FIGS. 2A and 2B are a schematic diagram illustrating a circuit for the receptacle of FIG. 1.
Figure 2B:
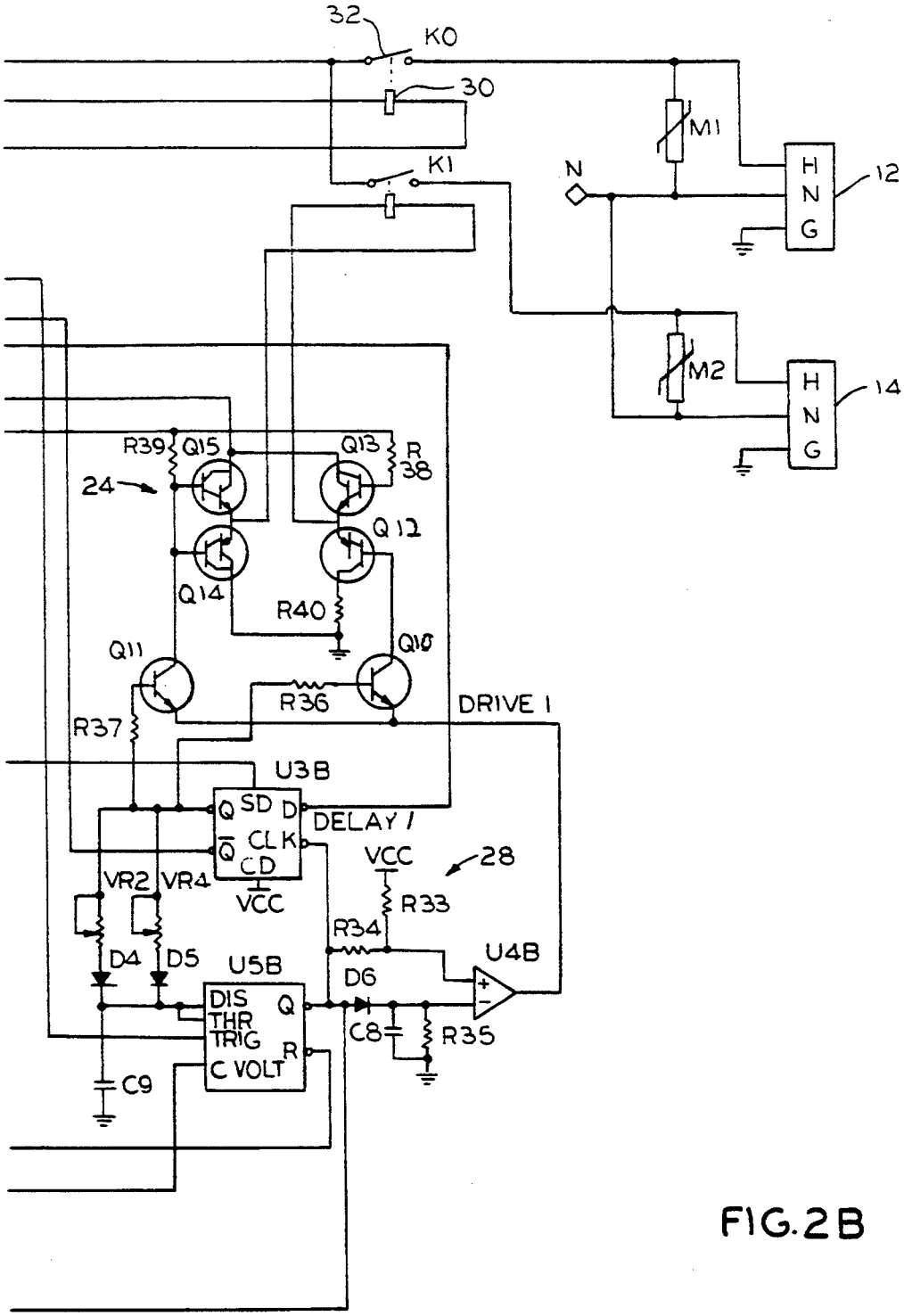

With reference to FIGS. 2A and 2B, a control circuit 17 for the switched power receptacle 10 is illustrated schematically. Generally, the control circuit 17 includes a power source 18, a first latching relay K0 for controlling the first outlet receptacle 12, and a second latching relay K1 for controlling the second outlet receptacle 14. A first switch circuit 22 selectively connects power from the power source 18 to the first latching relay K0. A second switch circuit 24 selectively connects power from the power source 18 to the second latching relay K1. The switch circuits 22 and 24 are driven by respective drive circuits 26 and 28, as commanded by a logic controller 20.

Each of the outlet receptacles 12 and 14 is identical in construction, as are the associated latching relays K0 and K1, switch circuits 22 and 24 and drive circuits 26 and 28. For simplicity herein, only the components associated with the first outlet receptacle 12 are described in detail, it being understood that the corresponding components for the second outlet receptacle 14 operate similarly.

The latching relay K0 has a relay coil 30 and an electrical contact 32 switched by the relay coil 30. The relay coil 30 is latched when connected to a positive polarity voltage source and unlatched when connected to a negative polarity voltage source.

In accordance with the invention, the latching relay K0 is permanently magnetized so that upon actuation by a relatively high current of positive polarity an included plunger is magnetically retained in an actuated position to close the contact 32. When reverse polarity power is connected to the relay coil 30, the magnetic field is reduced so that a spring force returns the plunger to an unlatched position opening the contact 32. The latching relay K0 may be of any conventional construction.

The power source 18 includes a terminal block 34 connected to a conventional 120 volt AC power source and having terminals labeled "H" for hot, "N" for neutral and "G" for ground. The electrical contact 32 is connected between the hot terminal H and the hot terminal of the outlet receptacle 12 for selectively applying power to the same. The neutral and ground terminals of the outlet receptacle 12 are connected to the corresponding terminals of the input terminal block 34.

The power supply circuit 18 is connected to the 120 volt power source via the terminal block 34. A transformer T1 reduces input voltage which is rectified by a full wave bridge rectifier BR1. The rectifier BR1 is connected via a resistor R44 to a storage capacitor C13 to develop unregulated DC power, labeled "HIGH+", for driving the latching relays K0 and K1. A voltage regulator circuit 36 is also connected to the bridge rectifier BR1 and a secondary tap on the transformer T1 for developing regulated voltage, labeled VCC, for powering various components, including the logic controller 20. The voltage regulator 36 may comprise, for example, an MC34160 microprocessor voltage regulator and supervisory circuit as manufactured by Motorola Inc.

The switch circuit 22 comprises an H-bridge circuit including transistors Q4, Q5, Q6 and Q7 connected in a bridge configuration. The H-bridge switch circuit 22 controls polarity of the power labeled HIGH+ connected to the latching relay K0. Particularly, the transistors Q5 and Q6 are simultaneously switched to connect positive polarity to the relay coil 30 for latching. The transistors Q4 and Q7 are simultaneously switched to connect negative polarity power to the relay coil 30. As such, the relay coil 30 is powered from a low voltage drive using energy stored in the storage capacitor C13.

The relay K0, being of the remnant-latching type, requires a well-defined pulse to operate. The pulse is developed by the drive circuit 26, as discussed below. To avoid over-magnetization during unlatching, a current limit resistor R23 is connected between the transistor Q7 and ground. The resistor R23 ensures that the negative amperes turns will create a zero flux density to reverse the latch. Particularly, the current limit resistor R23 prevents an unwanted negative flux density in the relay coil 30.

The drive circuit 26 is controlled by commands received from the logic controller 20. The logic controller 20 may be an integrated circuit including hardwired gates and latches to perform the described functions or may be a conventional microcontroller programmed for developing logic signals as necessary for the particular application. The logic controller 20 communications with the drive circuit 26 via four lines as follows: a control drive line, labeled "CDRV0", a switch control line labeled "SWCON0", a feedback line labeled "FBK0X" and a reset line labeled "R".

The drive circuit 26 includes a flip-flop U3A, a comparator U4A and a monostable multivibrator U5A and associated components discussed below.

The flip-flop U3A may be a type 74HC74 circuit chip. The multivibrator U5A may be a type TLC556C circuit chip having a trigger input connected to the CDRV0 line. Its output Q is connected via a line labeled "DELAY0" to the clock input of the flip-flop U3A. The data output for the flip-flop U3A is connected to the SWCON0 line from the logic controller 20. The SD terminal is connected to the reset line R. The non-inverted output is connected to a line labeled FBK0 which drives a transistor Q8 for controlling the H-bridge circuit 22 for latching of the relay K0. The inverted output is connected to the line FBKOX and to a transistor Q9 for controlling the H-bridge switch circuit 22 to control unlatching of the relay K0. The inverted output is also used to provide indirect feedback of relay status to the logic controller 20, as described below.

The multivibrator U5A, also referred to as a one shot or single shot, develops a pulse of a duration determined by an RC input to terminals labeled DIS and THR. These terminals are connected between an operate delay circuit 38 including a potentiometer VR1 to the non-inverted output of the flip-flop U3A and via a release delay circuit 40 to the inverted output of the flip-flop U3A, and to a capacitor C7. The potentiometers VR1 and VR3 are used to selectively adjust the duration of the one shot pulse signal from the multivibrator U5A. Particularly, the delay can be selected so that switching of the latching relay K0 coincides with a zero crossing of input power. In the latching mode, i.e., when the flip-flop U3A is set, its non-inverted output goes high so that the pulse duration is controlled by the operate delay circuit 38. In the unlatching mode, i.e., when the flip-flop U3A is reset, its inverted output goes high so that the pulse duration is selected by the release delay circuit 40.

The output of the multivibrator U5A is also connected via a diode D3 to an inverted input of the comparator U4A. Also connected to the inverted input are a parallel combination of a capacitor C6 and resistor R28. The non-inverted input of the comparator U4A is connected to a junction between resistors R32 and R30 which are connected in series between the VCC node and the output of the multivibrator U5A. The comparator U4A may comprise, for example, an LM339 type circuit chip. The output of the comparator U4A is connected to the emitter of each of the transistors Q8 and Q9, the collectors of which are connected to the respective H-bridge transistors Q4 and Q5, and Q6 and Q7.

The drive circuit 26 uses indirect feedback of relay status. Therefore, it is necessary to ensure that the feedback accurately represents the status of the relay K0. A voltage sensing circuit 42 operates in connection with an inhibit circuit 44 to inhibit pulsing of the latching relay coil 30 if the voltage is too low to ensure turn on. Otherwise, the status of the flip-flip U3A would be out of sync with the relay K0.

The sensing circuit 42 includes zener diodes ZD1 and ZD2 connected in series with a resistor R49 to the HIGH+ supply. The HIGH+ supply is also connected to the collector of a transistor Q16, the base of which is connected to the junction between the resistor R49 and the zener diode ZD1. The emitter of the transistor Q16 is connected to a node labeled 18+ connected to the H-bridge drive circuit 22. The inhibit circuit 44 includes a resistor R45 connected to the junction between the zener diodes ZD1 and ZD2 and the reset terminal of the multivibrator U5A. An additional resistor R50 is connected to the output of the multivibrator U5A.

Figure 3:
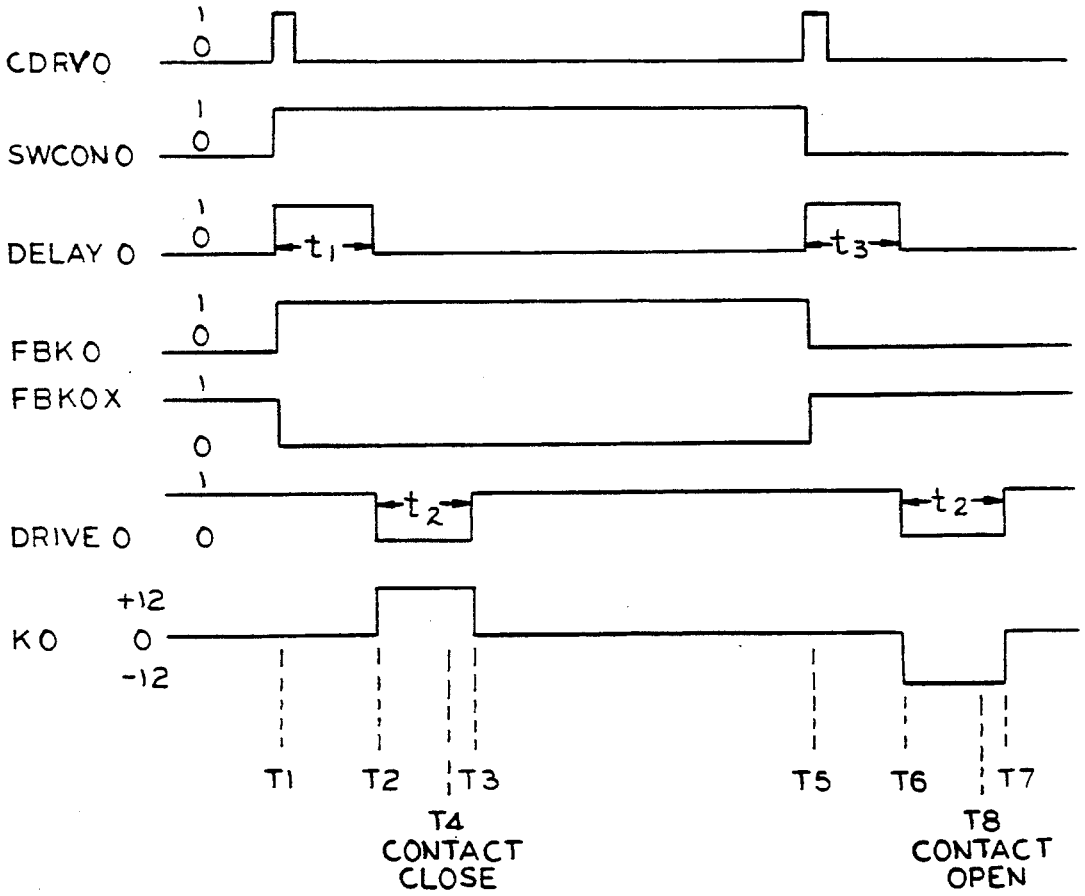
FIG. 3 is a timing diagram illustrating signals developed by various components of the schematic of FIG. 2.

With reference to FIG. 3, a timing diagram illustrates signal levels associated with controlling of the latching relay K0. The timing diagram initially illustrates signal levels of the circuit at power up, with the latching relay K0 in the unlatched state, i.e., the contact 32 is open. The timing diagram illustrates signals on the line CDRV0, SWCON0, DELAY0, FBK0, FBKOX, DRIVE0 and status of power applied to the relay K0.

A signal for commanding the latching or unlatching of the relay K0 is generated from the logic controller 20. The logic controller 20 could be acting in accordance with any desired parameter for triggering relay switching. For example, the command could be generated in response to a user actuation of a push button or toggle switch, the command could be based on time of day, or any other parameter for which the logic controller 20 has been programmed.

The desired state of the relay is commanded by the logic state of the switch control line SWCON0. When the line is at a logic high level, then it is desired to latch the relay K0, while when the line is at a logic low, it is desired to unlatch the relay K0. The actual switching occurs when a pulse is transmitted from the controller 20 on the control drive output line CDRV0 at a time $T_1$. As shown, this coincides with a leading edge of a high going signal on the switch control line SWCON0. The pulse on the CDRV0 line triggers the multivibrator U5A so that its output on the DELAY0 line goes high at the time $T_1$, ignoring normal circuit delays. The output of the multivibrator U5A clocks the flip-flop U3A so that the non-inverted output assumes the state of the data input, which is the signal on the line SWCON0, which is high. Conversely, the inverted output on the FBKOX line goes low. Consequently, the latched transistor Q8 receives a command at its base so that the H-bridge circuit 22 should be controlled to latch the relay coil 30. However, the signal on the line DRIVE0 from the comparator U4A is high so that the transistors Q8 and Q9 are inhibited from operation.

The signal on the DELAY0 line remains high for a select duration $t_1$ from the time $T_1$ to a time $T_2$ determined by the select resistance of the potentiometer VR1 in conjunction with the capacitor C7. When the DELAY0 output goes low at the time $T_2$, the output of the comparator U4A, i.e., the signal on the DRIVE0 line goes low, to enable the transistors Q8 and Q9. The transistor Q8 connected to the FBK0 line is switched on, while the transistor Q9 connected to the FBKOX line remains off so that the H-bridge circuit connects positive polarity power to the latching relay coil 30. The output of the comparator U4A remains low for a time duration $t_2$ determined by the capacitor C6 and resistor R28 until a time $T_3$. The time duration $t_2$ is selected to be of sufficient duration so that the relay K0 will latch to close the contact 32 at a time $T_4$ slightly before the time $T_3$. Thereafter, the H-bridge circuit 22 is disabled and the relay K0 remains latched. Indirect feedback status of the relay is read by the logic controller 20 as the status of the FBKOX line, recognizing that a low logic signal represents the relay contact 32 being closed.

The relay contact 32 remains closed until commanded to unlatch the relay K0 at a time $T_5$ when the switch control line SWCON0 is changed to logic low and the control drive CDRV0 line is pulsed high. This results in the DELAY0 signal being pulsed for a time duration $t_3$ determined by the release delay selected by the potentiometer VR3 until a time $T_6$ at which the DRIVE0 output goes low, again for a time duration $t_2$, to provide a negative polarity pulse at the relay K0 until a time $T_7$. Again, the time $t_2$ is selected so that the relay K0 will unlatch to open the contact 32 at a time $T_8$ prior to the time $T_7$. The indirect feedback signal line FBKOX being logic high indicates that the contact 32 is in the open state.

In the event that the DC power on the line HIGH+ is insufficient to switch the relay K0, as determined by the voltage sense circuit 42, then the inhibit circuit 44 resets the multivibrator U5A to prevent clocking of the flip-flop U3A or switching via the comparator U4A, so that the relay K0 remains in its current state. Thus, neither the relay state changes, nor does the state of the feedback from the flip-flop U3A, due to the inhibiting of the clocking signal. This feedback information can be used by the logic controller 20 to make additional attempts to change the relay state or go into an alarm or error mode, as necessary or desired.

The latching relay control circuit 17 as described herein is for use in connection with an outlet receptacle 12. An identical circuit could be used for controlling the latching relay for applying power to any electrical fixture, such as a light fixture. In such an instance, the outlet receptacle 12 is replaced with a terminal block for connection to such a fixture or other load device.

While the control circuit 26 and switch circuit 22 are illustrated schematically as electrical components, such functions could also be implemented in a programmed microprocessor. Additionally, the flipflop U3A which serves as a memory element could be replaced with a non-volatile memory element, such as a latching relay, a battery backed up memory circuit or an EEROM memory circuit.

Thus, in accordance with the invention, there is disclosed a circuit using indirect feedback of relay status. This circuit uses a flip-flop which tracks the last position of the latching relay and is immune to delayed responses which might be caused by using direct load sensing, which can act to sustain voltages to long after a latching relay opens. Moreover, the use of the voltage sensing and inhibit circuit ensures that accurate feedback is provided in the event that relay switching does not occur due to presence of a voltage too low to ensure proper switching of the latching relay.

We claim:

1. A control circuit controlling switching of a latching relay having a relay coil and an electrical contact switched by said relay coil, said relay coil being latched when connected to a positive polarity voltage source and unlatched when connected to a negative polarity voltage source, comprising:

a power source developing a voltage at a select potential;

a command circuit developing a command signal, said command signal assuming a first state to latch said relay coil or a second state to unlatch said relay coil;

a controllable switch circuit connected between said power source and the relay coil for selectively supplying a positive polarity voltage or a negative polarity voltage to said relay coil; and a drive circuit electrically connected between said command circuit and said switch circuit for controlling said switch circuit to supply a positive polarity voltage when said command signal assumes said first state and to supply a negative polarity voltage when said command signal assumes said second state, said drive circuit including a memory circuit storing a digital value representing if the voltage most recently supplied to said relay coil was of positive polarity or negative polarity, said digital value being transferred to said command circuit to ensure that the relay coil is in its desired state.

2. The control circuit of claim 1 wherein said memory circuit comprises a flip-flop circuit tracking state of the relay coil.

3. The control circuit of claim 2 wherein said drive circuit includes a timing circuit triggered by said command signal for controlling said switch circuit and wherein said flip-flop circuit is connected between said timing circuit and said switch circuit.

4. The control circuit of claim 3 wherein said digital value controls the polarity of voltage supplied by said switch circuit and said timing circuit selectively enables said switch circuit.

5. The control circuit of claim 1 wherein said switch circuit comprises an H-bridge switch circuit.

6. The control circuit of claim 1 further comprising a voltage sense circuit for sensing the select potential of said power source voltage and an inhibit circuit connected between said sense circuit and said drive circuit for inhibiting operation of said drive circuit if said select potential is below a select value.

7. A switched power receptacle comprising:

a power source developing a voltage at a select potential;

a latching relay having a relay coil and an electrical contact switched by said relay coil, said relay coil being latched when connected to a positive polarity voltage source and unlatched when connected to a negative polarity voltage source;

an outlet receptacle connected in series with said contact and to said power source;

a command circuit developing a command signal, said command signal assuming a first state to latch said relay coil to power said outlet receptacle or a second state to unlatch said relay coil to disable said outlet receptacle;

a controllable switch circuit connected between said power source and the relay coil for selectively supplying a positive polarity voltage or a negative polarity voltage to said relay coil; and a drive circuit electrically connected between said command circuit and said switch circuit for controlling said switch circuit to supply a positive polarity voltage when said command signal assumes said first state and to supply a negative polarity voltage when said command signal assumes said second state, said drive circuit including a memory circuit storing a digital value representing if the voltage most recently supplied to said relay coil was of positive polarity or negative polarity, said digital value being transferred to said command circuit to ensure that the relay coil is in its desired state.

8. The switched power receptacle of claim 7 wherein said memory circuit comprises a flip-flop circuit tracking state of the relay coil.

9. The switched power receptacle of claim 8 wherein said drive circuit includes a timing circuit triggered by said command signal for controlling said switch circuit and wherein said flip-flop circuit is connected between said timing circuit and said switch circuit.

10. The switched power receptacle of claim 9 wherein said digital value controls the polarity of voltage supplied by said switch circuit and said timing circuit selectively enables said switch circuit.

11. The switched power receptacle of claim 7 wherein said switch circuit comprises an H-bridge switch circuit.

12. The switched power receptacle of claim 7 further comprising a voltage sense circuit for sensing the select potential of said power source voltage and an inhibit circuit connected between said sense circuit and said drive circuit for inhibiting operation of said drive circuit if said select potential is below a select value.

13. A switched power receptacle comprising:

a power source developing a voltage at a select potential;

a latching relay having a relay coil and an electrical contact switched by said relay coil, said relay coil being latched when connected to a positive polarity voltage source and unlatched when connected to a negative polarity voltage source;

an outlet receptacle connected in series with said contact and to said power source;

a command circuit developing a command signal, said command signal assuming a first state to latch said relay coil to power said outlet receptacle or a second state to unlatch said relay coil to disable said outlet receptacle;

an H-bridge circuit connected between said power source and the relay coil; and a drive circuit electrically connected between said command circuit and said H-bridge circuit for controlling said H-bridge circuit between a set mode and a reset mode, said set mode comprising controlling said H-bridge circuit to supply a positive polarity voltage when said command signal assumes said first state and said reset mode comprises controlling said H-bridge circuit to supply a negative polarity voltage when said command signal assumes said second state, said drive circuit including a memory circuit storing a digital value representing said mode, said digital value being transferred to said command circuit to ensure that the relay coil is in its desired state.

14. The switched power receptacle of claim 13 wherein said memory circuit comprises a flip-flop circuit tracking state of the relay coil.

15. The switched power receptacle of claim 14 wherein said drive circuit includes a timing circuit triggered by said command signal for controlling said switch circuit and wherein said flip-flop circuit is connected between said timing circuit and said switch circuit.

16. The switched power receptacle of claim 13 further comprising a voltage sense circuit for sensing the select potential of said power source voltage and an inhibit circuit connected between said sense circuit and said drive circuit for inhibiting operation of said drive circuit if said select potential is below a select value.

17. A control circuit controlling switching of a latching relay having a relay coil and an electrical contact switched by said relay coil, said relay coil being latched when connected to a positive polarity voltage source and unlatched when connected to a negative polarity voltage source, comprising:

a power source developing a voltage at a select potential;

a command circuit developing a command signal to switch said latching relay;

a controllable switch circuit connected between said power source and the relay coil for selectively supplying a positive polarity voltage or a negative polarity voltage to said relay coil;

a drive circuit electrically connected between said command circuit and said switch circuit for controlling said switch circuit to supply a positive or negative polarity voltage to said coil as commanded by said command signal;

a voltage sense circuit for sensing the select potential of said power source voltage; and an inhibit circuit connected between said sense circuit and said drive circuit for inhibiting operation of said drive circuit if said select potential is below a select value.

* * * * *